US005785037A

United States Patent [19]

Maki et al.

[11] Patent Number: 5,785,037

[45] Date of Patent: Jul. 28, 1998

[54] FUEL METERING CONTROL SYSTEM FOR INTERNAL COMBUSTION ENGINE

[75] Inventors: Hidetaka Maki; Shusuke Akazaki, both of Wako, Japan

[73] Assignee: Honda Giken Kogyo Kabushiki Kaisha, Tokyo, Japan

[21] Appl. No.: 602,112

[22] Filed: Feb. 23, 1996

[30] Foreign Application Priority Data

Feb. 25, 1995 [JP] Japan ..... 7-061665

[51] Int. Cl.[6] ..... F02D 41/14

[52] U.S. Cl. ..... 123/684; 123/690; 123/696

[58] Field of Search ..... 123/681, 690, 123/696, 684

[56] References Cited

U.S. PATENT DOCUMENTS 5,445,136 8/1995 Yamashita et al. ..... 123/689

FOREIGN PATENT DOCUMENTS 1-110853 4/1989 Japan .
2-275043 11/1990 Japan .
7-247886 9/1995 Japan .

OTHER PUBLICATIONS

"Digital Adaptive Control" *Computrol*, No. 27, Jul. 10, 1989, pp. 28–41.

"Automatic Control Handbook", Ohm, Ltd., Japan, pp. 701–707, Oct. 30, 1983.

"A Survey of Model Reference Adaptive Techniques—Theory and Applications", Landau, *Automatica*, vol. 10, 1974, pp. 353–379.

"Unification of Discrete Time Explicit Model Reference Adaptive Control Designs", Landau et al, *Automatica*, vol. 17, No. 4, 1981, pp. 593–611.

"Combining Model Reference Adaptive Controllers and Stochastic Self-tuning Regulators", Landau, *Automatica*, vol. 18, No. 1, 1982, pp. 77–84.

*Primary Examiner*—Andrew M. Dolinar

*Attorney, Agent, or Firm*—Nikaido, Marmelstein, Murray & Oram LLP

[57] ABSTRACT

A system for controlling fuel metering for an internal combustion engine having a feedback system which has a controller for calculating a feedback correction coefficient, using an adaptive control law to correct a quantity of fuel injection such that a detected air/fuel ratio is brought to a desired air/fuel ratio. In the system, it is discriminated whether the feedback correction coefficient and the detected air/fuel ratio are in phase, and the feedback system is instable when they are discriminated to be in phase. Since the coefficient acts to correct the deviation of the detected air/fuel ratio from the desired air/fuel ratio, they are normally in antiphase. It is thus possible to find the system instable, by discriminating whether they are in phase or not.

60 Claims, 7 Drawing Sheets

FUEL METERING CONTROL SYSTEM FOR INTERNAL COMBUSTION ENGINE

BACKGROUND OF THE INVENTION

1. Field of the Invention

This invention relates to a fuel metering control system for an internal combustion engine.

2. Description of the Related Art

The application of adaptive control theory to internal combustion engines in recent years has led to the development of technologies for adaptively controlling the actual quantity of fuel drawn into the engine cylinders to the desired fuel quantity, as taught, for example, by Japanese Laid-Open Patent Application No. Hei 1(1989)-110,853. The assignee's Japanese Laid-Open Patent Application No. Hei 7(1995)-247,886 (filed in the United States on Mar. 9, 1995 under the number 08/401,430) also teaches fuel metering control in an internal combustion engine using adaptive control.

Fuel metering control using a feedback correction coefficient calculated by a high response control such as the adaptive control makes it possible to converge the detected air/fuel ratio to a desired value in a short period. However, if the feedback correction coefficient is calculated improperly, this may rather, contrary to what is expected, render the exhaust air/fuel ratio instable. This could occur if the cause-and-effect relationship between the input and the output of the system, i.e., the manipulated variable determined by the feedback correction coefficient and the exhaust air/fuel ratio indicating that the controlled variable deviates, is lost, such as due to a misfiring or a malfunction of the air/fuel ratio sensor.

Therefore, it is necessary to detect easily and immediately if the feedback system has become instable and take any appropriate countermeasures so that the system does not oscillate any more.

SUMMARY OF THE INVENTION

An object of the invention is provide a fuel metering control system for an internal combustion engine having a feedback system that uses a high response feedback correction coefficient, which makes it possible to detect a feedback system instability easily and immediately so as to prevent the system from oscillating any more, thereby enhancing control stability of the system.

This invention achieves the object by providing a system for controlling fuel metering for an internal combustion engine having a plurality of cylinders and an exhaust system, said system comprising, an air/fuel ratio sensor installed in said exhaust system of the engine for detecting an air/fuel ratio of the engine, engine operating condition detecting means for detecting engine operating conditions including at least engine speed and engine load, fuel injection quantity determining means, operatively coupled to said engine operating condition detecting means, for determining a quantity of fuel injection for a cylinder of the engine based on at least the detected engine operating conditions, a feedback system having a controller means for calculating a feedback correction coefficient, using a control law expressed in a recursion formula, to correct the quantity of fuel injection, such that a controlled variable obtained based on at least the detected air/fuel ratio detected by said air/fuel ratio sensor is brought to a desired value, output fuel injection quantity determining means operatively coupled to said fuel injection quantity determining means and said feedback system, for determining an output quantity of fuel injection, said output fuel injection quantity determining means correcting the basic quantity of fuel injection based on the feedback correction coefficient to determine the output quantity of fuel injection when engine operation is in a feedback control region and a fuel injector means operatively coupled to said output fuel injection quantity determining means, for injecting fuel in the cylinder of the engine based on the determined output quantity of fuel injection. In the system, comparing means is provided for comparing the feedback correction coefficient with the detected air/fuel ratio, and feedback system instability discriminating means is provided and operatively coupled to said feedback system, for discriminating whether said feedback system is instable based on a result of the comparison.

BRIEF EXPLANATION OF THE DRAWINGS

These and other objects and advantages of the invention will be more apparent from the following description and drawings, which show the invention by way of example only, and in which.

DETAILED DESCRIPTION OF THE PREFERRED EMBODIMENTS

Embodiments of the invention, given by way of example only, will now be explained with reference to the drawings.

Figure 1:
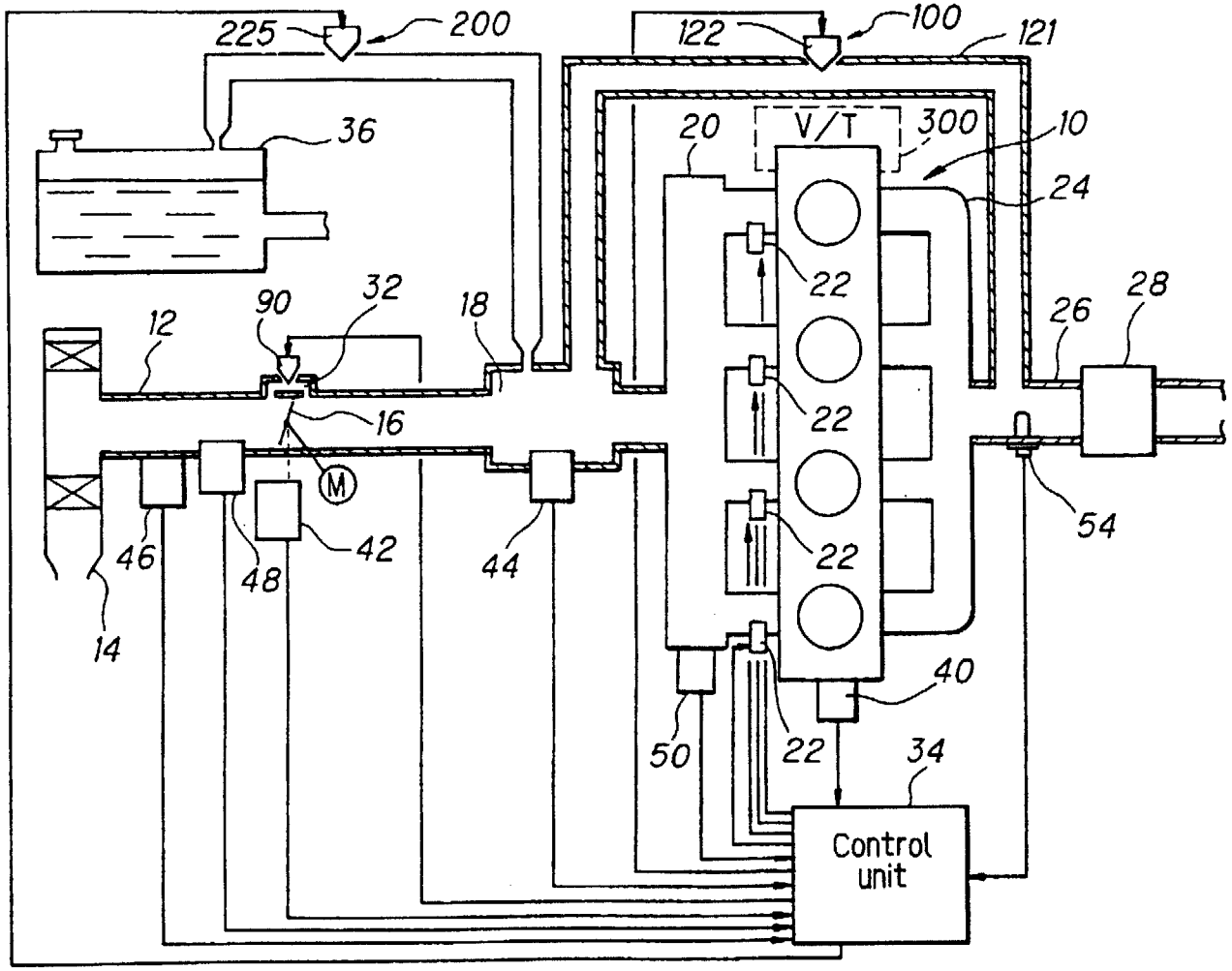
FIG. 1 is an overall schematic view showing a fuel metering control system for an internal combustion engine according to the present invention.

FIG. 1 is an overview of a fuel metering control system for an internal combustion engine according to the invention.

Reference numeral 10 in this figure designates an overhead cam (OHC) in-line four-cylinder (multi-cylinder) internal combustion engine. Air drawn into an air intake pipe 12 through an air cleaner 14 mounted on a far end thereof is supplied to each of the first to fourth cylinders through a surge tank 18, an intake manifold 20 and two intake valves (not shown), while the flow thereof is adjusted by a throttle valve 16. A fuel injector (fuel injection means) 22 is installed in the vicinity of the intake valves of each cylinder for injecting fuel into the cylinder. The injected fuel mixes with the intake air to form an air-fuel mixture that is ignited in the associated cylinder by a spark plug (not shown) in the firing order of #1, #3, #4 and #2 cylinder. The resulting combustion of the air-fuel mixture drives a piston (not shown) down.

The exhaust gas produced by the combustion is discharged through two exhaust valves (not shown) into an exhaust manifold 24, from where it passes through an exhaust pipe 26 to a catalytic converter (three-way catalyst) 28 where noxious components are removed therefrom before it is discharged to the exterior. Not mechanically linked with the accelerator pedal (not shown), the throttle valve 16 is controlled to a desired degree of opening by a stepping motor M. In addition, the throttle valve 16 is bypassed by a bypass 32 provided at the air intake pipe 12 in the vicinity thereof.

The engine 10 is equipped with an exhaust gas recirculation (EGR) mechanism 100 which recirculates a part of the exhaust gas to the intake side via a recirculation pipe 121, and a canister purge mechanism 200 connected between the air intake system and a fuel tank 36.

The engine 10 is also equipped with a variable valve timing mechanism 300 (denoted as V/T in FIG. 1). As taught by Japanese Laid-open Patent Application No. Hei 2(1990) -275,043, for example, the variable valve timing mechanism 300 switches the opening/closing timing of the intake and/or exhaust valves between two types of timing characteristics: a characteristic for low engine speed designated LoV/T, and a characteristic for high engine speed designated HiV/T in response to engine speed Ne and manifold pressure Pb. Since this is a well-known mechanism, however, it will not be described further here.

The engine 10 of FIG. 1 is provided in its ignition distributor (not shown) with a crank angle sensor 40 for detecting the piston crank angle and is further provided with a throttle position sensor 42 for detecting the degree of opening of the throttle valve 16, and a manifold absolute pressure sensor 44 for detecting the pressure Pb of the intake manifold downstream of the throttle valve 16 in terms of absolute value. An atmospheric pressure sensor 46 for detecting atmospheric pressure Pa is provided at an appropriate portion of the engine 10, an intake air temperature sensor 48 for detecting the temperature of the intake air is provided upstream of the throttle valve 16, and a coolant temperature sensor 50 for detecting the temperature of the engine coolant is also provided at an appropriate portion of the engine. The engine 10 is further provided with a valve timing (V/T) sensor 52 (not shown in FIG. 1) which detects the valve timing characteristic selected by the variable valve timing mechanism 300 based on oil pressure.

Further, an air/fuel sensor 54 constituted as an oxygen detector or oxygen sensor is provided in the exhaust pipe 26 at, or downstream of, a confluence point in the exhaust system, between the exhaust manifold 24 and the catalytic converter 28, where it detects the oxygen concentration in the exhaust gas at the confluence point and produces a corresponding signal (explained later). The outputs of the sensors are sent to the control unit 34.

Figure 2:
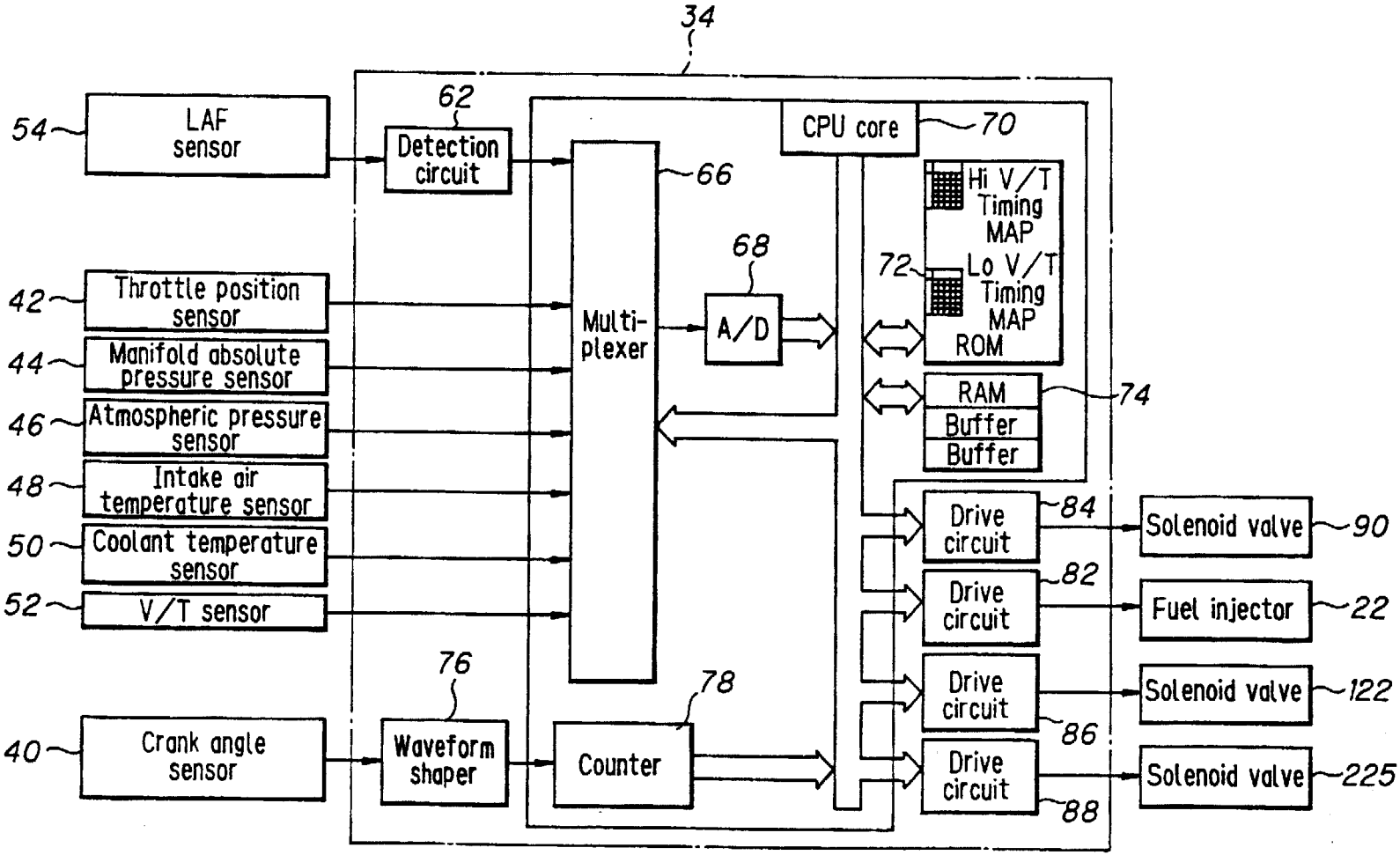
FIG. 2 is a block diagram showing the details of a control unit illustrated in FIG. 1.

Details of the control unit 34 are shown in the block diagram of FIG. 2. The output of the air/fuel ratio sensor 54 is received by a detection circuit 62, where it is subjected to appropriate linearization processing for producing an output characterized in that it varies linearly with the oxygen concentration of the exhaust gas over a broad range extending from the lean side to the rich side. (The air/fuel ratio sensor is denoted as "LAF sensor" in the figure and will be so referred to in the remainder of this specification.)

The output of the detection circuit 62 is forwarded through a multiplexer 66 and an A/D converter 68 to a CPU (central processing unit). The CPU has a CPU core 70, a ROM (read-only memory) 72 and a RAM (random access memory) 74, and the output of the detection circuit 62 is A/D-converted once every prescribed crank angle (e.g., 15 degrees) and stored in buffers of the RAM 74. Similarly, the analog outputs of the throttle position sensor 42, etc., are input to the CPU through the multiplexer 66 and the A/D converter 68 and stored in the RAM 74.

The output of the crank angle sensor 40 is shaped by a waveform shaper 76 and has its output value counted by a counter 78. The result of the count is input to the CPU. In accordance with commands stored in the ROM 72, the CPU core 70 computes a manipulated variable in the manner described later and drives the fuel injectors 22 of the respective cylinders via a drive circuit 82. Operating via drive circuits 84, 86 and 88, the CPU core 70 also drives a solenoid valve (EACV) 90 (for opening and closing the bypass 32 to regulate the amount of secondary air), a solenoid valve 122 for controlling the aforesaid exhaust gas recirculation, and a solenoid valve 225 for controlling the aforesaid canister purge.

Figure 3:
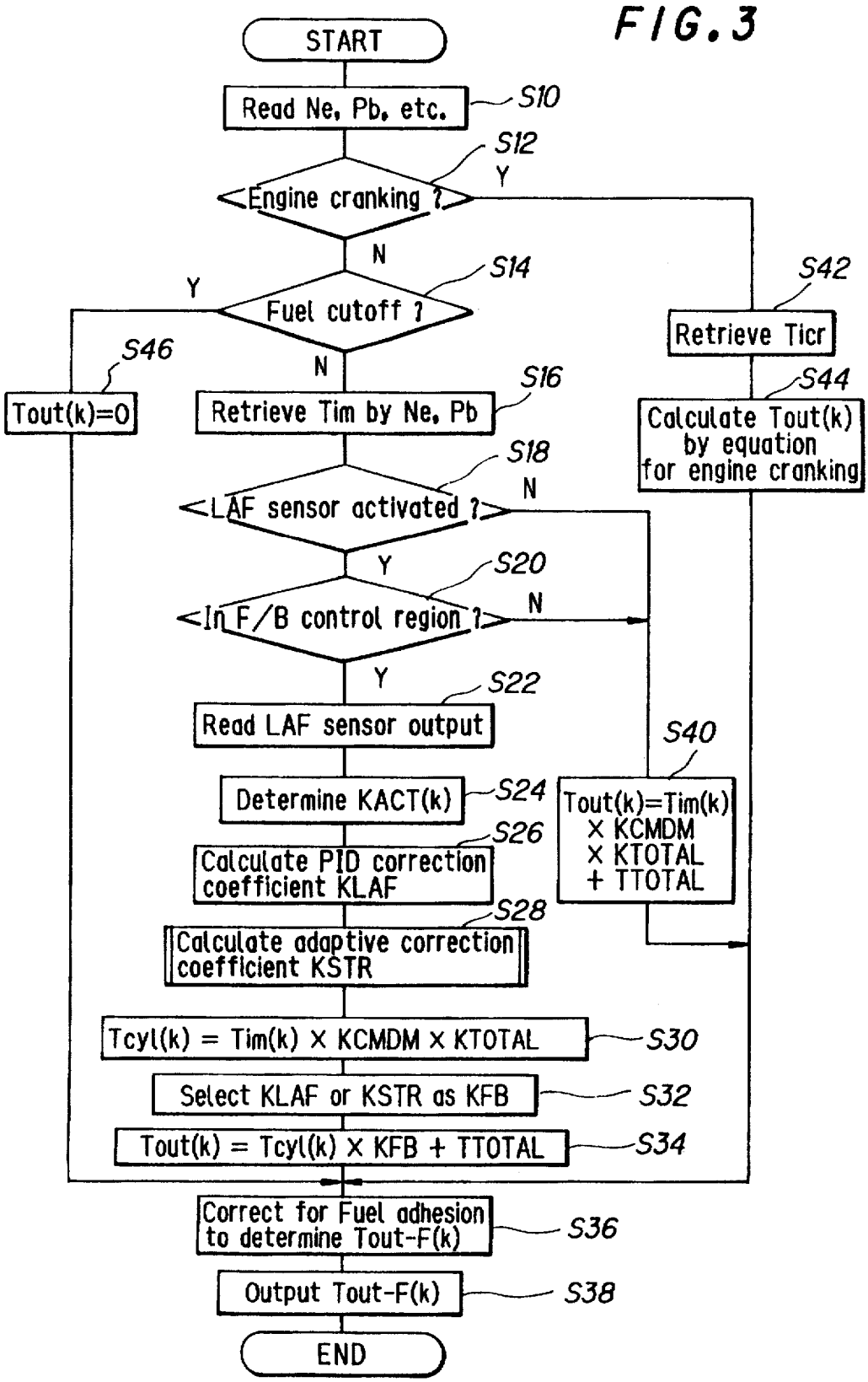
FIG. 3 is a flowchart showing the operation of the system according to the invention.

FIG. 3 is a flowchart showing the operation of the system. The program is activated at a predetermined crank angular position such as every TDC (Top Dead Center) of the engine.

In FIG. 3, the program starts at S10 in which the detected engine speed Ne, the manifold pressure Pb, etc., are read and the program proceeds to S12 in which it is checked whether or not the engine is cranking, and if it is not, to S14 in which it is checked whether the supply of fuel is cut off. Fuel cutoff is implemented under a specific engine operating condition, such as when the throttle is fully closed and the engine speed is higher than a prescribed value, at which time the supply of fuel is stopped and fuel injection is controlled in an open-loop manner.

When it is found in S14 that fuel cutoff is not implemented, the program proceeds to S16 in which the basic quantity of fuel injection Tim is calculated by retrieval from mapped data using the detected engine speed Ne and manifold pressure Pb as address data. Next, the program proceeds to S18 in which it is checked whether activation of the LAF sensor 54 is completed. This is done by comparing the difference between the output voltage and the center voltage of the LAF sensor 54 with a prescribed value (0.4 V, for example) and determining that the activation has been completed when the difference is smaller than the prescribed value.

When S18 finds that the activation has been completed, the program goes to S20 in which it is checked whether the engine operating condition is in a feedback control region. Fuel metering is controlled in an open-loop fashion, for example, such as during full-load enrichment or high engine speed, or when the engine operating condition has changed suddenly owing to the high coolant temperature.

When the result of S20 is affirmative, the program proceeds to S22 in which the output of the LAF sensor is read, and to S24 in which the air/fuel ratio KACT(k)(k: a sample number in the discrete time system) is determined or detected. The program then goes to S26 in which a feedback correction coefficient KLAF is calculated based on a PID control law (PID controller) (hereinafter referred to as "PID correction coefficient").

The PID correction coefficient KLAF is calculated as follows.

First, the control error DKAF between the desired air/fuel ratio KCMD and the detected air/fuel ratio KACT is calculated as:

$$DKAF(k)=KCMD(k-d')-KACT(k).$$

In this equation, KCMD(k−d') is the past desired air/fuel ratio (in which d' indicates the dead time before KCMD is reflected in KACT and thus signifies the desired air/fuel ratio before the dead time control cycle), and KACT(k) is the detected air/fuel ratio (in the current control (program) cycle).

It should further be noted that the detected air/fuel ratio and the desired air/fuel ratio are expressed as, in fact, the equivalence ratio, i.e., as Mst/M=1/lambda (Mst: stoichiometric air/fuel ratio; M: A/F (A: air mass flow rate; F: fuel mass flow rate; lambda: excess air factor), so as to facilitate the calculation.

Next, the control error DKAF(k) is multiplied by specific coefficients to obtain control constants (gains), i.e., the P term KLAFP(k), I term KLAFI(k), and D term KLAFD(k) as $$P \text{ term: } KLAFP(k)=DKAF(k)\times KP$$

$$I \text{ term: } KLAFI(k)=KLAFI(k-1)+(DKAF(k)\times KI)$$

$$D \text{ term: } KLAFD(k)=(DKAF(k)-DKAF(k-1))\times KD.$$

Thus, the P term is calculated by multiplying the error by the proportional gain KP; the I term is calculated by adding the value of KLAFI(k−1), the feedback correction coefficient in the preceding control cycle (k−1), to the product of the error and the integral gain KI; and the D term is calculated by multiplying the difference between the value of DKAF(k), the error in the current control cycle, and the value of DKAF(k−1), the error in the preceding control cycle (k−1), by the differential gain KD. The gains KP, KI and KD are prepared as mapped data such that they are retrievable using the engine speed Ne and the manifold pressure Pb as address data. Finally, KLAF(k), the value of the feedback correction coefficient according to the PID control law in the current control cycle, is calculated by summing the thus obtained values:

$$KLAF(k)=KLAFP(k)+KLAFI(k)+KLAFD(k).$$

It should be noted here that KLAFI(k) include an offset of 1.0 so that the value KLAF is a multiplicative correction coefficient. In other words, the initial value of KLAFI is set to be 1.0.

The program then goes to S28 in which a feedback correction coefficient KSTR is calculated based on an adaptive control law (adaptive controller) (hereinafter referred to as the "adaptive correction coefficient KSTR".) The calculation of the adaptive correction coefficient will be explained later.

The program then proceeds to S30 in which the basic quantity of fuel injection (the amount of fuel supply) Tim is multiplied by a desired air/fuel ratio correction coefficient KCMDM (a value determined by correcting the desired air/fuel ratio KCMD (expressed in equivalence ratio) by the charging efficiency of the intake air), and the product of other correction coefficients KTOTAL (the product of various correction coefficients to be made through multiplication including correction based on the coolant temperature) to determine the required quantity of fuel injection Tcyl(k).

The program then proceeds to S32 in which either the PID correction coefficient KLAF or the adaptive correction coefficient is selected as the feedback correction coefficient KFB. This will be explained later. Then the program proceeds to S34 in which the required quantity of fuel injection Tcyl(k) is multiplied by the feedback correction coefficient KFB and the product resulting therefrom is added by the sum of additive correction terms TTOTAL. Here, TTOTAL indicates the total value of the various corrections for atmospheric pressure, etc., conducted by addition (but does not include the fuel injector dead time, etc., which is added separately at the time of outputting the corrected quantity of fuel injection Tout-F(k)(explained later).

The program then proceeds to S36 in which the output quantity of fuel injection Tout(k) is corrected for fuel adhesion by using a fuel adhesion correction coefficient obtained by retrieving mapped data using parameters including the engine coolant temperature, to determine the corrected quantity of fuel injection Tout-F(k). Since the fuel adhesion correction itself has no close relationship with the gist of the invention, no explanation is made of the correction. The program next proceeds to S38 in which the corrected quantity of fuel injection Tout-F(k) is applied to the fuel injector 22.

When the result in S18 or S20 is NO, the program goes to S40 in which the basic quantity of fuel injection Tim(k) is multiplied by the desired air/fuel ratio correction coefficient KCMDM and the product of other correction coefficients KTOTAL and the product resulting therefrom is added by the sum of additive correction terms TTOTAl to determine the output quantity of fuel injection Tout(k), and then to S36 and on. If S12 finds that the engine is cranking, the program goes to S42 in which the quantity of fuel injection at cranking Ticr is retrieved, and then to S44 in which Ticr is used to calculate the output quantity of fuel injection Tout based on an equation for engine cranking. If S14 finds that fuel cutoff is in effect, the output quantity of fuel injection Tout(k) is set to 0 in S46.

The calculation of the adaptive correction coefficient KSTR(k) referred to in S28 will be explained, with reference to FIG. 4.

Figure 4:
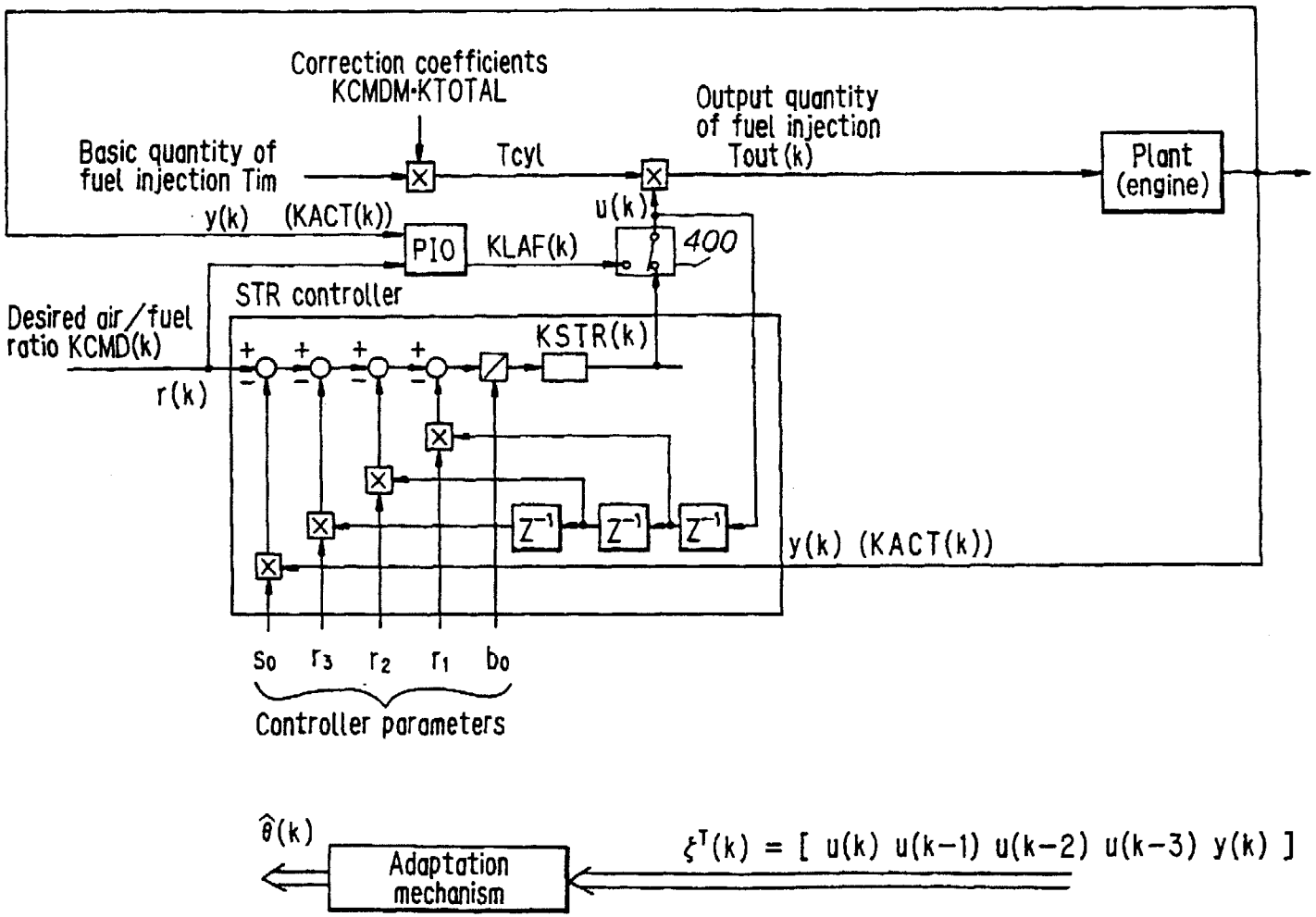
FIG. 4 is a block diagram showing the configuration of the adaptive control system in the fuel metering control system according to the invention.

FIG. 4 illustrates the system according to the invention including the calculation of the coefficient.

The system illustrated there is based on adaptive control technology proposed in an earlier application by the assignee. It comprises an adaptive controller constituted as an STR (self-tuning regulator) controller (controller means) and an adaptation mechanism (adaptation mechanism means) (system parameter estimator) for estimating/identifying the controller parameters (system parameters) (dynamic engine characteristic parameters) $\hat{\theta}$. The desired value and the controlled variable (plant output) of the fuel metering feedback control system are input to the STR controller, which receives the coefficient vector (i.e., the controller parameters expressed in a vector) $\hat{\theta}$ estimated/identified by the adaptation mechanism, and generates an output.

One identification or adaptation law (algorithm) available for adaptive control is that proposed by I. D. Landau et al. In the adaptation law proposed by I. D. Landau et al., the stability of the adaptation law expressed in a recursion formula is ensured at least using Lyapunov's theory or Popov's hyperstability theory. This method is described in, for example, *Computrol* (Corona Publishing Co., Ltd.) No. 27, pp. 28–41; *Automatic Control Handbook* (Ohm Publishing Co., Ltd.) pp. 703–707; "A Survey of Model Reference Adaptive Techniques—Theory and Applications" by I. D. Landau in *Automatica*, Vol. 10, pp. 353–379, 1974; "Unification of Discrete Time Explicit Model Reference Adaptive Control Designs" by I. D. Landau et al. in *Automatica*, Vol. 17, No. 4, pp. 593–611, 1981; and "Combining Model Reference Adaptive Controllers and Stochastic Self-tuning Regulators" by I. D. Landau in *Automatica*, Vol. 18, No. 1, pp. 77–84, 1982.

The adaptation or identification algorithm of I. D. Landau et al. is used in the assignee's earlier proposed adaptive control technology. In this adaptation or identification algorithm, when the polynomials of the denominator and numerator of the transfer function $B(Z^{-1})/A(Z^{-1})$ of the discrete controlled system are defined in the manner of Eq. 1 and Eq. 2 shown below, then the controller parameters or system (adaptive) parameters $\hat{\theta}(k)$ are made up of parameters as shown in Eq. 3 and are expressed as a vector (transpose vector). And the input zeta (k) to the adaptation mechanism becomes that shown by Eq. 4. Here, there is taken as an example a plant in which m=1, n=1 and d=3, namely, the plant model is given in the form of a linear system with three control cycles of dead time.

$$A(z^{-1}) = 1 + a_1 z^{-1} + \ldots + a_n z^{-n} \quad \text{Eq. 1}$$

$$B(z^{-1}) = b_0 + b_1 z^{-1} + \ldots + b_m z^{-m} \quad \text{Eq. 2}$$

$$\begin{aligned} \hat{\theta}^T(k) &= [\hat{b}_0^{-1}(k), \hat{B}_R(z^{-1}, k), \hat{S}(z^{-1}, k)] \\ &= [\hat{b}_0(k), \hat{r}_1(k), \ldots, r_{m+d-1}(k), s_0(k), \ldots, s_{n-1}(k)] \\ &= [b_0(k), r_1(k), r_2(k), r_3(k), s_0(k)] \end{aligned} \quad \text{Eq. 3}$$

$$\begin{aligned} \zeta^T(k) &= [u(k), \ldots, u(k-m-d+1), y(k), \ldots, y(k-n+1)] \\ &= [u(k), u(k-1), u(k-2), u(k-3), y(k)] \end{aligned} \quad \text{Eq. 4}$$

Here, the factors of the controller parameters $\hat{\theta}$, i.e., the scalar quantity $\hat{b}_0^{-1}(k)$ that determines the gain, the control factor $\hat{B}_R(Z^{-1},k)$ that uses the manipulated variable and $\hat{S}(Z^{-1},k)$ that uses the controlled variable, all shown in Eq. 3, are expressed respectively as Eq. 5 to Eq. 7.

$$\hat{b}_0^{-1}(k) = 1/b_0 \quad \text{Eq. 5}$$

$$\begin{aligned} \hat{B}_R(Z^{-1}, k) &= r_1 z^{-1} + r_2 z^{-2} + \ldots + r_{m+d-1} z^{-(m+d-1)} \\ &= r_1 z^{-1} + r_2 z^{-2} + r_3 z^{-3} \end{aligned} \quad \text{Eq. 6}$$

$$\begin{aligned} \hat{S}(Z^{-1}, k) &= s_0 + s_1 z^{-1} + \ldots + s_{n-1} z^{-(n-1)} \\ &= s_0 \end{aligned} \quad \text{Eq. 7}$$

As shown in Eq. 3, the adaptation mechanism estimates or identifies each coefficient of the scalar quantity and control factors, calculates the controller parameters (vector) $\hat{\theta}$, and supplies the controller parameters $\hat{\theta}$ to the STR controller. More specifically, the adaptation mechanism calculates the controller parameters $\hat{\theta}$ using the manipulated variable u(i) and the controlled variable y (j) of the plant (i,j include past values) such that the control error between the desired value and the controlled variable becomes zero.

More precisely, the controller parameters (vector) $\hat{\theta}(k)$ are calculated by Eq. 8 below. In Eq. 8, $\Gamma(k)$ is a gain matrix (the (m+n+d)th order square matrix) that determines the estimation/identification rate or speed of the controller parameters $\hat{\theta}$, and $e^*(k)$ is a signal indicating the generalized estimation/identification error, i.e., an estimation error signal of the controller parameters. They are represented by recursion formulas such as those of Eqs. 9 and 10.

$$\theta(k) = \theta(k-1) + \Gamma(k-1)\zeta(k-d)e^*(k) \quad \text{Eq. 8}$$

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k) + \lambda_2(k)\,\zeta^T(k-d)\Gamma(k-1)\zeta(k-d)}\right] \quad \text{Eq. 9}$$

-continued $$e^*(k) = \frac{D(z^{-1})y(k) - \theta^T(k-1)\zeta(k-d)}{1 + \zeta^T(k-d)\Gamma(k-1)\zeta(k-d)} \quad \text{Eq. 10}$$

Various specific algorithms are given depending on the selection of lambda 1(k) and lambda 2(k) in Eq. 9. lambda 1(k)=1, lambda 2(k)=lambda (0<lambda<2) gives the gradually-decreasing gain algorithm (least-squares method when lambda=1); and lambda 1(k)=lambda 1 (0<lambda 1<1), lambda 2(k)=lambda 2 (0<lambda 2<lambda) gives the variable-gain algorithm (weighted least-squares method when lambda 2=1). Further, defining lambda 1(k)/lambda 2(k)=σ and representing lambda 3(k) as in Eq. 11, the constant-trace algorithm is obtained by defining lambda 1(k)=lambda 3(k). Moreover, lambda 1(k)=1, lambda 2(k)=0 gives the constant-gain algorithm. As is clear from Eq. 9, in this case $\Gamma(k)=\Gamma(k-1)$, resulting in the constant value $\Gamma(k)=\Gamma$. Any of the algorithms are suitable for the time-varying plant such as the fuel metering control system according to the invention.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \quad \text{Eq. 11}$$

In the diagram of FIG. 4, the STR controller (adaptive controller) and the adaptation mechanism (system parameter estimator) are placed outside the system for calculating the quantity of fuel injection (fuel injection quantity determining means) and operate to calculate the feedback correction coefficient KSTR(k) so as to adaptively bring the detected value KACT(k) to the desired value KCMD(k–d') (where, as mentioned earlier, d' is the dead time before KCMD is reflected in KACT). In other words, the STR controller receives the coefficient vector $\hat{\theta}(k)$ adaptively estimated/identified by the adaptive mechanism and forms a feedback compensator (feedback control loop) so as to bring it to the desired value KCMD(k–d'). The basic quantity of fuel injection Tim is multiplied by the calculated feedback correction coefficient KSTR(k), and the corrected quantity of fuel injection is supplied to the controlled plant (internal combustion engine) as the output quantity of fuel injection Tout(k).

Thus, the feedback correction coefficient KSTR(k) and the detected air/fuel ratio KACT(k) are determined and input to the adaptation mechanism, which calculates/estimates the controller parameters (vector) $\hat{\theta}(k)$ that are in turn input to the STR controller. Based on these values, the STR controller uses the recursion formula to calculate the feedback correction coefficient KSTR(k) so as to bring the detected air/fuel ratio KACT(k) to the desired air/fuel ratio KCMD (k–d'). The feedback correction coefficient KSTR(k) is specifically calculated as shown by Eq. 12:

$$KSTR(k) = \frac{KCMD(k-d') - s_0 x y(k) - r_1 x KSTR(k-1) - r_2 x KSTR(k-2) - r_3 x KSTR(k-3)}{b_0} \quad \text{Eq. 12}$$

On the other hand, the detected value KACT(k) and the desired value KCMD(k) are also input to the aforesaid PID controller (shown as "PID" in the figure) which calculates the PID correction coefficient KLAF(k) based on the PID control law as explained in connection with S26 of FIG. 3 flowchart so as to eliminate the control error between the detected value at the exhaust system confluence point and the desired value.

One or the other of the feedback correction coefficient KSTR, obtained by the adaptive control law, and the PID correction coefficient KLAF, obtained using the PID control law, is selected to be used in determining the quantity of fuel injection by a switching mechanism 400 shown in FIG. 4. As will be explained later, when the operation of the adaptive control system (STR controller) is found to be instable, or when the engine operating condition is found to be outside the operation region of the adaptive control system, the PID correction coefficient KLAF is, instead of the adaptive correction coefficient KSTR, used.

Next, the selection of the feedback correction coefficient shown in S32 of the flowchart of FIG. 3 will now be explained.

Figure 5:
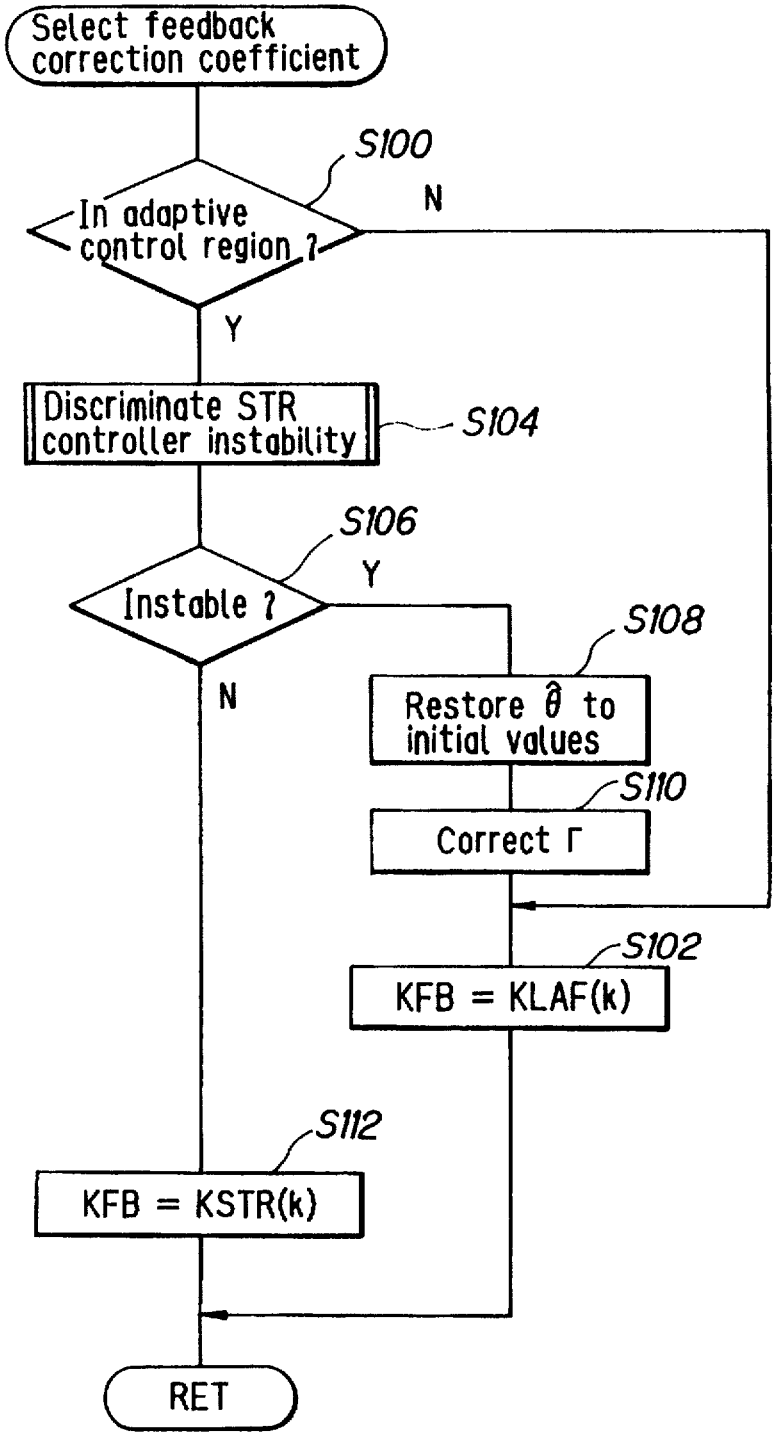
FIG. 5 is a subroutine flowchart of FIG. 3 showing the selection of feedback correction coefficients calculated in the procedures of FIG. 3.

The subroutine for this operation is shown by the flowchart of FIG. 5.

The subroutine begins at S100 in which it is checked whether the engine operating condition is in the operation region of the adaptive control system. Regions in which combustion is instable, such as when the coolant temperature is extremely low, are defined as falling outside the adaptive operation region since they do not permit accurate detection/calculation of the air/fuel ratio KACT(k). When the result in S100 is NO, the program goes to S102 in which the PID correction coefficient KLAF(k) is selected as the feedback correction coefficient KFB.

When the result is YES, the program goes to S104 in which it is discriminated whether the adaptive control system (STR controller) is instable.

Figure 6:
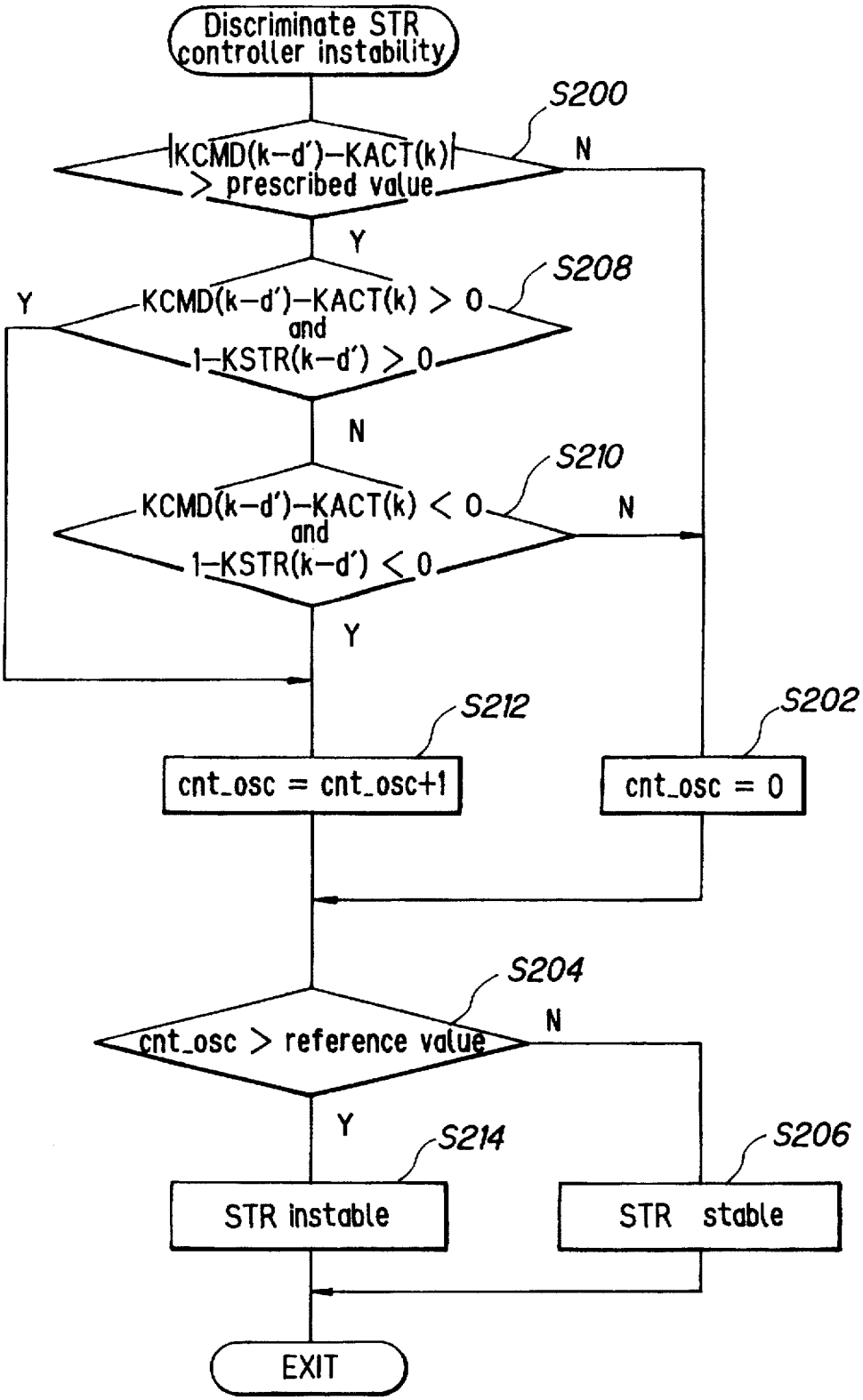
FIG. 6 is a subroutine flowchart of FIG. 5 showing the discrimination of adaptive control system instability referred to in FIG. 5.

FIG. 6 is a flowchart showing the discrimination of the system instability.

Before entering the explanation of the flowchart, the system instability discrimination according to the invention will first be described.

As stated before, the adaptive correction coefficient KSTR causes the system to operate to eliminate the deviation of the detected air/fuel ratio KACT from the desired value KCMD. However, with the change of the coefficient KSTR, the system may sometimes operate to render the detected air/fuel ratio KACT instable, i.e., out of control. This state is the so-called "oscillation"state. Since the STR controller calculates the coefficient KSTR in a recursion formula, when the fuel injection quantity correction by the coefficient KSTR is made when, such as during a misfiring, the cause-and-effect relationship does not exist between the input and the output, it is not possible to obtain the detected air/fuel ratio that properly corresponds to the corrected fuel injection quantity, resulting in oscillation. Whatever the reason may be, the oscillation should be detected immediately to take any countermeasures therefor.

Figure 7:
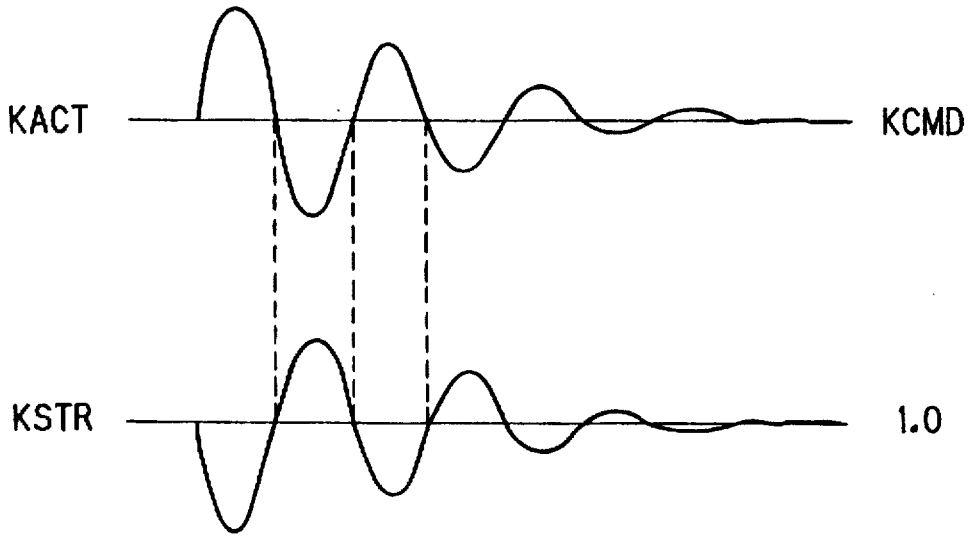
FIG. 7 is a timing chart showing the operation of FIG. 6 in which the adaptive control system is stable.

For that purpose, the inventors perceived the fact that the coefficient KSTR caused the system to operate to correct the deviation of the detected air/fuel ratio KACT from the desired value KCMD, and have made the invention. To be specific, since the coefficient KSTR, more precisely KSTR (k) acts to correct the deviation of the detected air/fuel ratio KACT(k), the coefficient KSTR and the detected air/fuel ratio KACT are in antiphase, i.e., opposite or inimical in phase, as shown in FIG. 7, when the aforesaid cause-and-effect relationship is present between the input and the output of the system.

Figure 8:
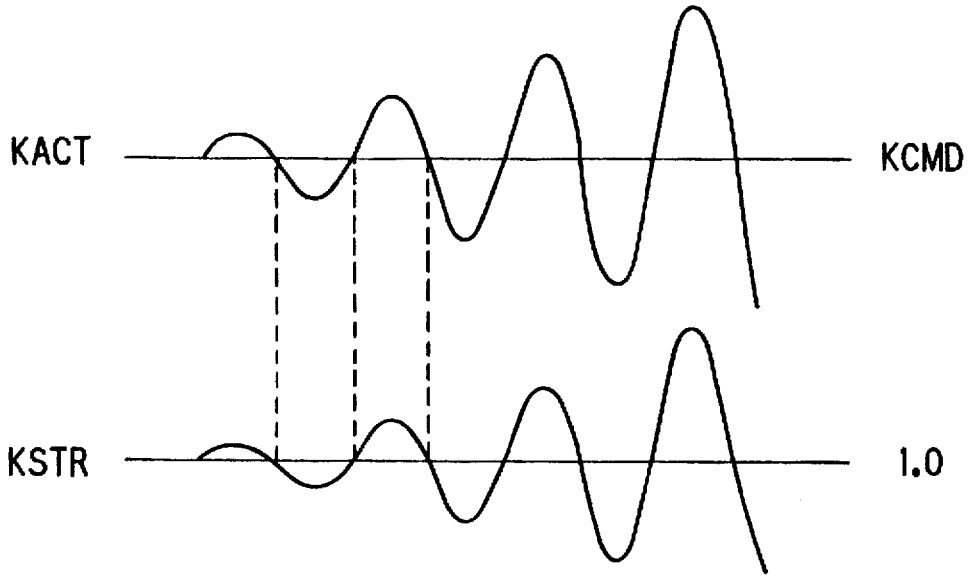
FIG. 8 is a timing chart showing the operation of FIG. 6 in which the adaptive control system is instable.

On the other hand, if the relationship between the input and the output is lost, the detected air/fuel ratio KACT and the coefficient KSTR become in phase, as illustrated in FIG. 8. In addition, since the coefficient KSTR becomes larger as does the detected air/fuel ratio KACT to be close and equal to the desired air/fuel ratio KCMD(k–d'), both become gradually larger with respect to time, as illustrated in the figure. The coefficient KSTR increases or decreases centering on 1.0. When conducting a comparison using (KCMD (k–d')–KACT(k)) and (1–KSTR(k–d'), it is therefore possible to discriminate whether KACT and KSTR are in antiphase or in phase. Thus, it is possible to discriminate whether or not the adaptive control system is instable.

Explaining the FIG. 6 flowchart based on the above, the program begins at S200 in which it is checked whether the difference in absolute value between the desired air/fuel ratio and the detected air/fuel ratio is greater than a prescribed value, i.e., it is checked whether the detected value does not converge to the desired value. When the result of S200 is NO, since the detected value converges to the detected value so that the system is stable, the program proceeds to S202 in which a counter cnt_osc is reset to zero, and to S204 in which the counter value is compared with a reference value. Since the counter value has just been reset to zero, the result in S204 is naturally NO and the program goes to S206 in which it is judged that the adaptive control system (STR controller) operation is stable.

On the other hand, when the difference is found to be greater than the prescribed value in S200, the program proceeds to S208 in which it is checked whether the difference between the desired air/fuel ratio and the detected air/fuel ratio is positive and in addition, if the difference between 1.0 and the coefficient is also positive, in other words, it is checked whether the detected air/fuel ratio and the coefficient are in phase in the positive direction. When the result in S208 is NO, the program proceeds to S210 in which it is checked whether the difference between the desired air/fuel ratio and the detected air/fuel ratio is negative and in addition, if the difference between 1.0 and the coefficient is also negative, in other words, it is checked whether the detected air/fuel ratio and the coefficient are in phase in the negative direction.

When the result in either S208 or S210 is YES, the program goes to S212 in which the counter value is incremented, to S204 in which the counter value is compared with the reference value. When the result is NO, the program proceeds to S206 in which the STR controller operation is discriminated to be stable. This is because even when the difference between the desired air/fuel ratio and the detected air/fuel ratio is found to be greater than the prescribed value and they are found to be in phase, that might be a transitory situation due to a temporary cause. Such a case should preferably be distinguished to continue the STR controller operation. Since the counter value cnt_osc indicates the number of times the values are consecutively found to be in phase, a transitory in-phase situation will accordingly be distinguished. With the arrangement, even when the values are transitorily in phase due to a temporary cause, it can avoid discriminating such a condition to be instable.

On the other hand, when the result in S204 is YES, the program goes to S214 in which the STR controller operation is discriminated to be instable. In the above, when the result in S210 is NO, the program proceeds to S202 to reset the counter value, since, although the difference between the desired air/fuel ratio and the detected air/fuel ratio is found to be larger than the prescribed value, they are not in phase so that it can be concluded that the STR controller operation is stable.

Returning to the explanation of the FIG. 5 flowchart, the program then proceeds to S106 in which it is checked whether the adaptive control system has been discriminated to be instable and if the result is affirmative, the program goes to S108 in which the controller parameters $\hat{\theta}$ are restored to their initial values. This restores the system stability. The program next goes to S110 in which the gain matrix $\Gamma$ is corrected. Since the gain matrix $\Gamma$ determines the rate or speed of change (convergence) of the adaptation mechanism, this correction is made so as to slow the convergence rate. Specifically, the elements of the gain matrix Γ are replaced with small values. This also enables restoration of system stability.

The program then goes to S102 in which the PID correction coefficient KLAF(k) is selected as the feedback correction coefficient KFB. On the other hand, when S106 finds that the adaptive control system is not instable, the program goes to S112 in which, as shown, the adaptive correction coefficient KSTR(k) is selected as the feedback correction coefficient KFB.

The output u(k) of the switching mechanism 400 in the block diagram of FIG. 4 is input to the STR controller and the adaptation mechanism. This is to enable calculation of the adaptive correction coefficient KSTR during periods when the PID correction coefficient KLAF is selected.

Configured in the foregoing manner, the embodiment can discriminate easily and immediately whether the adaptive control system is instable and when discriminated to be instable, take any appropriate countermeasures such as restoring the controller parameters $\hat{\theta}(k)$ to their initial values, decreasing the gain matrix Γ such that the convergence rate or speed becomes slow, or switching the adaptive feedback correction coefficient KSTR to the PID correction coefficient KLAP of less response, thereby preventing the system from oscillating any more and enhancing the control stability. For that purpose, it suffices if only one from among steps S102, S108 or S110 is selected in the FIG. 5 flowchart.

Moreover, since the embodiment is configured such that the number of times in which the adaptive correction coefficient KSTR and the detected air/fuel ratio KACT are in phase are counted, then when the counted value has reached a reference value, it discriminates that the system is instable. With the arrangement, even when the values are transitorily in phase due to a temporary cause, it can avoid such a condition from being discriminated to be instable.

Although PID control is taken as an example in the embodiment, it is permissible instead to appropriately set the KP, KI and KD gains for conducting PI control and to control only the I term. In other words, the PID control referred to in the specification is established insofar as it includes some of the gain terms.

Although the air/fuel ratio is used as the desired value in the embodiment, it is alternatively possible to use the quantity of fuel injection itself as the desired value.

Although the feedback correction coefficient is determined as a multiplication coefficient in the first and second embodiments, it can instead be determined as an additive value.

Although a throttle valve is operated by the stepper motor in the first and second embodiments, it can instead be mechanically linked with the accelerator pedal and be directly operated in response to the accelerator depression.

Furthermore, although the aforesaid embodiments are described with respect to examples using STR, MRACS (model reference adaptive control systems) can be used instead.

Although the invention has thus been shown and described with reference to specific embodiments, it should be noted that the invention is in no way limited to the details of the described arrangements but changes and modifications may be made without departing from the scope of the invention, which is defined by the appended claims.

What is claimed is:

1. A system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a basic quantity of fuel injection for a cylinder of the engine based on at least the detected engine operating conditions;

a feedback system having an adaptive controller and an adaptation mechanism, said adaptation mechanism receiving a controlled variable based on at least an output of said air-fuel ratio sensor and past values of a feedback correction coefficient and estimating controller parameters that are input to the adaptive controller, said adaptive controller receiving the controlled variable and the past values of the feedback correction coefficient, and, based upon the input controller parameters calculating the feedback correction coefficient to correct the basic quantity of fuel injection, such that the controlled variable is brought to a desired value;

output fuel injection quantity determining means operatively coupled to said fuel injection quantity determining means and said feedback system, for determining an output quantity of fuel injection, said output fuel injection quantity determining means correcting the basic quantity of fuel injection based on the feedback correction coefficient to determine the output quantity of fuel injection when engine operation is in a feedback control region; and a fuel injector means operatively coupled to said output fuel injection quantity determining means, for injecting fuel in the cylinder of the engine based on the determined output quantity of fuel injection;

wherein:

a comparing means is provided for comparing the feedback correction coefficient with the detected air/fuel ratio in terms of phase; and a feedback system instability discriminating means is provided and operatively coupled to said feedback system, for discriminating whether said feedback system is instable based on a result of the comparison, said feedback system instability discriminating means causing said adaptation mechanism to estimate the controller parameters such that the feedback system restores stability when the feedback system is discriminated to be instable.

2. A system according to claim 1, further including:

a second feedback system having a second controller means for calculating a second feedback correction coefficient, using a second control law whose control response is less than that of the first control law, to correct the basic quantity of fuel injection such that the controlled variable is brought to the desired value; and said output fuel injection quantity determining means corrects the basic quantity of fuel injection based on the second feedback correction coefficient, when said system instability discriminating means discriminates that said first feedback system is instable.

3. A system according to claim 2, wherein the second control law is a PID control law that includes at least one of a P gain, an I gain and a D gain.

4. A system according to claim 2, wherein the control law expressed in a recursion formula is an adaptive control law.

5. A system according to claim 1, wherein the control law expressed in a recursion formula is an adaptive control law.

6. A system according to claim 5, wherein said adaptive controller calculating said feedback correction coefficient using internal variables that include at least said controller parameters.

7. A system according to claim 6, wherein the feedback correction coefficient is multiplied by the basic quantity of fuel injection.

8. A system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a basic quantity of fuel injection for a cylinder of the engine based on at least the detected engine operating conditions;

a feedback system having an adaptive controller and an adaptation mechanism that estimates controller parameters that are input to the adaptive controller, said adaptive controller calculating a feedback correction coefficient, using a control law expressed in a recursion formula, to correct the basic quantity of fuel injection, such that a controlled variable obtained based on at least the detected air/fuel ratio detected by said air/fuel ratio sensor is brought to a desired value;

output fuel injection quantity determining means operatively coupled to said fuel injection quantity determining means and said feedback system, for determining an output quantity of fuel injection, said output fuel injection quantity determining means correcting the basic quantity of fuel injection based on the feedback correction coefficient to determine the output quantity of fuel injection when engine operation is in a feedback control region; and a fuel injector means operatively coupled to said output fuel injection quantity determining means, for injecting fuel in the cylinder of the engine based on the determined output quantity of fuel injection;

wherein:

a comparing means is provided for comparing the feedback correction coefficient with the detected air/fuel ratio; and a feedback system instability discriminating means is provided and operatively coupled to said feedback system, for discriminating whether said feedback system is instable based on a result of the comparison, said feedback system instability discriminating means causing said adaptation mechanism to estimate the controller parameters such that the feedback system restores stability when the feedback system is discriminated to be instable;

wherein said comparing means comprises:

phase discriminating means for discriminating whether the feedback correction coefficient and the detected air/fuel ratio are in phase; and said feedback system instability discriminating means discriminates that said feedback system is instable when the feedback correction coefficient and the detected air/fuel ratio are determined to be in phase.

9. A system according to claim 8, wherein said phase discriminating means discriminates whether the feedback correction coefficient and the detected air/fuel ratio are in phase for a predetermined number of intervals; and said feedback system instability discriminating means discriminates that said feedback system is instable when the feedback correction coefficient and the detected air/fuel ratio are discriminated to be in phase for the predetermined number of intervals.

10. A system according to claim 8, wherein said phase discriminating means comprises:

air/fuel ratio difference calculating means for calculating a first difference between the desired value and the detected air/fuel ratio to compare it with a prescribed value;

coefficient difference calculating means for calculating a second difference between the feedback correction coefficient and 1.0;

difference comparing means for comparing the first and the second differences with zero, when the first difference is found to be greater than the prescribed value; and said feedback system instability discriminating means discriminates that said feedback system is instable when the first and the second differences are found to be greater than zero.

11. A system according to claim 10, wherein said counting means counts up the number of times that the first and the second differences are found to be greater than zero when the first difference is found to be greater than the prescribed value, while it counts down the counted number when the first and the second differences are found to be not greater than zero or when the first difference is found to be not greater than the prescribed value; and said feedback system instability discriminating means discriminates that said feedback system is instable when the counted number reaches the reference value.

12. A system according to claim 8, wherein said phase discriminating means comprises:

air/fuel ratio difference calculating means for calculating a first difference between the desired value and the detected air/fuel ratio to compare it with a prescribed value for a predetermined number of intervals;

coefficient difference calculating means for calculating a second difference between the feedback correction coefficient and 1.0;

difference comparing means for comparing the first and the second differences with zero for the predetermined number of intervals, when the first difference is found to be greater than the prescribed value;

counting means for counting the number of times that the first and the second differences are found to be greater than zero when the first difference is found to be greater than the prescribed value; and said feedback system instability discriminating means discriminates that said feedback system is instable when the counted number reaches a reference value.

13. A system according to claim 8, further including:

a second feedback system having a second controller means for calculating a second feedback correction coefficient, using a second control law whose control response is less than that of the first control law, to correct the basic quantity of fuel injection such that the controlled variable is brought to the desired value; and said output fuel injection quantity determining means corrects the basic quantity of fuel injection based on the second feedback correction coefficient, when said system instability discriminating means discriminates that said first feedback system is instable.

14. A system according to claim 13, wherein the second control law is a PID control law that includes at least one of a P gain, an I gain and a D gain.

15. A system according to claim 8, wherein the control law expressed in a recursion formula is an adaptive control law.

16. A computer program controlled system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a basic quantity of fuel injection for a cylinder of the engine based on at least the detected engine operating conditions;

a feedback system having an adaptive controller and an adaptation mechanism, said adaptation mechanism receiving a controlled variable based on at least an output of said air-fuel ratio sensor and past values of a feedback correction coefficient and estimating controller parameters that are input to the adaptive controller, said adaptive controller receiving the controlled variable and the past values of the feedback correction coefficient, and, based upon the input controller parameters, calculating the feedback correction coefficient to correct the basic quantity of fuel injection, such that the controlled variable is brought to a desired value;

output fuel injection quantity determining means operatively coupled to said fuel injection quantity determining means and said feedback system, for determining an output quantity of fuel injection, said output fuel injection quantity determining means correcting the basic quantity of fuel injection based on the feedback correction coefficient to determine the output quantity of fuel injection when engine operation is in a feedback control region; and a fuel injector means operatively coupled to said output fuel injection quantity determining means, for injecting fuel in the cylinder of the engine based on the determined output quantity of fuel injection;

wherein:

a comparing means is provided for comparing the feedback correction coefficient with the detected air/fuel ratio in terms of phase; and a feedback system instability discriminating means is provided and operatively coupled to said feedback system, for discriminating whether said feedback system is instable based on a result of the comparison, said feedback system instability discriminating means causing said adaptation mechanism to estimate the controller parameters such that the feedback system restores stability when the feedback system is discriminated to be instable.

17. A computer program controlled system according to claim 16, further including:

a second feedback system having a second controller means for calculating a second feedback correction coefficient, using a second control law whose control response is less than that of the first control law, to correct the basic quantity of fuel injection such that the controlled variable is brought to the desired value; and said output fuel injection quantity determining means corrects the basic quantity of fuel injection based on the second feedback correction coefficient, when said system instability discriminating means discriminates that said first feedback system is instable.

18. A computer program controlled system according to claim 16, wherein the control law expressed in a recursion formula is an adaptive control law.

19. A computer program controlled system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a basic quantity of fuel injection for a cylinder of the engine based on at least the detected engine operating conditions;

a feedback system having an adaptive controller and an adaptation mechanism that estimates controller parameters that are input to the adaptive controller, said adaptive controller calculating a feedback correction coefficient, using a control law expressed in a recursion formula, to correct the basic quantity of fuel injection, such that a controlled variable obtained based on at least the detected air/fuel ratio detected by said air/fuel ratio sensor is brought to a desired value;

output fuel injection quantity determining means operatively coupled to said fuel injection quantity determining means and said feedback system, for determining an output quantity of fuel injection, said output fuel injection quantity determining means correcting the basic quantity of fuel injection based on the feedback correction coefficient to determine the output quantity of fuel injection when engine operation is in a feedback control region; and a fuel injector means operatively coupled to said output fuel injection quantity determining means, for injecting fuel in the cylinder of the engine based on the determined output quantity of fuel injection;

wherein:

a comparing means is provided for comparing the feedback correction coefficient with the detected air/fuel ratio; and a feedback system instability discriminating means is provided and operatively coupled to said feedback system, for discriminating whether said feedback system is instable based on a result of the comparison, said feedback system instability discriminating means causing said adaptation mechanism to estimate the controller parameters such that the feedback system restores stability when the feedback system is discriminated to be instable;

wherein said comparing means comprises:

phase discriminating means for discriminating whether the feedback correction coefficient and the detected air/fuel ratio are in phase; and said feedback system instability discriminating means discriminates that said feedback system is instable when the feedback correction coefficient and the detected air/fuel ratio are determined to be in phase.

20. A method for controlling fuel metering for an internal combustion engine having a plurality of cylinders and an exhaust system, said method comprising the steps of:

detecting an air/fuel ratio of the engine;

detecting engine operating conditions including at least engine speed and engine load;

determining a basic quantity of fuel injection for a cylinder of the engine based on at least the detected engine operating conditions;

controlling with a feedback system having an adaptive controller and an adaptation mechanism, said adaptation mechanism receiving a controlled variable based on at least an output of said air-fuel ratio sensor and past values of a feedback correction coefficient and estimating controller parameters that are input to the adaptive controller, said adaptive controller receiving the controlled variable and the past values of the feedback correction coefficient, and, based upon the input controller parameters, calculating the feedback correction coefficient to correct the basic quantity of fuel injection, such that a controlled variable is brought to a desired value;

determining an output quantity of fuel injection, while correcting the basic quantity of fuel injection based on the feedback correction coefficient to determine the output quantity of fuel injection when engine operation is in a feedback control region; and injecting fuel in the cylinder of the engine based on the determined output quantity of fuel injection;

wherein:

a phase of the feedback correction coefficient is compared with a phase of the detected air/fuel ratio; and a discrimination step is performed to discriminate whether said feedback system is instable based on a result of the comparison, and causing said adaptation mechanism to estimate said controller parameters such that said feedback system restores stability when said feedback system is discriminated to be instable.

21. A method according to claim 20, further including:

controlling with a second feedback system having a second controller means for calculating a second feedback correction coefficient, using a second control law whose control response is less than that of the first control law, to correct the basic quantity of fuel injection such that the controlled variable is brought to the desired value; and correcting the basic quantity of fuel injection based on the second feedback correction coefficient, when it is discriminates that said first feedback system is instable.

22. A method according to claim 20, wherein the control law expressed in a recursion formula is an adaptive control law.

23. A method for controlling fuel metering for an internal combustion engine having a plurality of cylinders and an exhaust system, said method comprising the steps of:

detecting an air/fuel ratio of the engine;

detecting engine operating conditions including at least engine speed and engine load;

determining a basic quantity of fuel injection for a cylinder of the engine based on at least the detected engine operating conditions;

controlling with a feedback system having an adaptive controller and an adaptation mechanism that estimates controller parameters that are input to the adaptive controller, said adaptive controller calculating a feedback correction coefficient, using a control law expressed in a recursion formula, to correct the basic quantity of fuel injection, such that a controlled variable obtained based on at least the detected air/fuel ratio is brought to a desired value;

determining an output quantity of fuel injection, while correcting the basic quantity of fuel injection based on the feedback correction coefficient to determine the output quantity of fuel injection when engine operation is in a feedback control region; and injecting fuel in the cylinder of the engine based on the determined output quantity of fuel injection;

wherein:

comparing the feedback correction coefficient with the detected air/fuel ratio; and discriminating whether said feedback system is instable based on a result of the comparison, and causing said adaptation mechanism to estimate said controller parameters such that said feedback system restores stability when said feedback system is discriminated to be instable; wherein said step of comparing comprises the steps of:

discriminating whether the feedback correction coefficient and the detected air/fuel ratio are in phase; and discriminating that said feedback system is instable when the feedback correction coefficient and the detected air/fuel ratio are determined to be in phase.

24. A computer program embodied on a computer readable medium for controlling fuel metering for an internal combustion engine having a plurality of cylinders and an exhaust system, said computer program comprising the steps of:

detecting an air/fuel ratio of the engine;

detecting engine operating conditions including at least engine speed and engine load;

determining a basic quantity of fuel injection for a cylinder of the engine based on at least the detected engine operating conditions;

controlling with a feedback system having an adaptive controller and an adaptation mechanism, said adaptation mechanism receiving a controlled variable based on at least an output of said air-fuel ratio sensor and past values of a feedback correction coefficient and estimating controller parameters that are input to the adaptive controller, said adaptive controller receiving the controlled variable and the past values of the feedback correction coefficient, and, based upon the input controller parameters, calculating the feedback correction coefficient to correct the basic quantity of fuel injection, such that the controlled variable is brought to a desired value;

determining an output quantity of fuel injection, while correcting the basic quantity of fuel injection based on the feedback correction coefficient to determine the output quantity of fuel injection when engine operation is in a feedback control region; and injecting fuel in the cylinder of the engine based on the determined output quantity of fuel injection;

wherein:

a phase of the feedback correction coefficient is compared with a phase of the detected air/fuel ratio; and a discrimination step is performed to discriminate whether said feedback system is instable based on a result of the comparison, and causing said adaptation mechanism to estimate said controller parameters such that said feedback system restores stability when said feedback system is discriminated to be instable.

25. A computer program according to claim 24, further including:

controlling with a second feedback system having a second controller means for calculating a second feedback correction coefficient, using a second control law whose control response is less than that of the first control law, to correct the basic quantity of fuel injection such that the controlled variable is brought to the desired value; and correcting the basic quantity of fuel injection based on the second feedback correction coefficient when it is discriminates that said first feedback system is instable.

26. A computer program according to claim 24, wherein the control law expressed in a recursion formula is an adaptive control law.

27. A computer program embodied on a computer readable medium for controlling fuel metering for an internal combustion engine having a plurality of cylinders and an exhaust system, said computer program comprising the steps of:

detecting an air/fuel ratio of the engine;

detecting engine operating conditions including at least engine speed and engine load;

determining a basic quantity of fuel injection for a cylinder of the engine based on at least the detected engine operating conditions;

controlling with a feedback system having an adaptive controller and an adaptation mechanism that estimates controller parameters that are input to the adaptive controller, said adaptive controller calculating a feedback correction coefficient, using a control law expressed in a recursion formula, to correct the basic quantity of fuel injection, such that a controlled variable obtained based on at least the detected air/fuel ratio is brought to a desired value;

determining an output quantity of fuel injection, while correcting the basic quantity of fuel injection based on the feedback correction coefficient to determine the output quantity of fuel injection when engine operation is in a feedback control region; and injecting fuel in the cylinder of the engine based on the determined output quantity of fuel injection;

wherein:

comparing the feedback correction coefficient with the detected air/fuel ratio; and discriminating whether said feedback system is instable based on a result of the comparison, and causing said adaptation mechanism to estimate said controller parameters such that said feedback system restores stability when said feedback system is discriminated to be instable; wherein said step of comparing comprises the steps of:

discriminating whether the feedback correction coefficient and the detected air/fuel ratio are in phase; and discriminating that said feedback system is instable when the feedback correction coefficient and the detected air/fuel ratio are determined to be in phase.

28. A system for controlling fuel metering for an internal combustion engine having a plurality of cylinders and an exhaust system, said system comprising:

an air/fuel ratio sensor installed in the exhaust system of the engine for detecting an air/fuel ratio of the engine;

engine operating condition detecting means for detecting engine operating conditions including at least engine speed and engine load;

fuel injector means connected to the engine for injecting fuel into a cylinder of the engine; and a controller coupled to said air/fuel ratio sensor, said engine operating condition detecting means, and said fuel injector means, said controller being configured to determine a basic quantity of fuel injection for the cylinder of the engine based on at least the detected engine operating conditions;

calculate a first feedback correction coefficient using an adaptive controller and an adaptation mechanism, said adaptation mechanism receiving a controlled variable based on at least an output of said air-fuel ratio sensor and past values of a feedback correction coefficient and estimating controller parameters that are input to the adaptive controller, said adaptive controller receiving the controlled variable and the past values of the feedback correction coefficient based on the input controller parameters, such that the controlled variable obtained based on the detected air/fuel ratio is brought to a desired value;

determine an output quantity of fuel injection, said output quantity of fuel injection being determined by the basic quantity of fuel injection being corrected by the first feedback correction coefficient when the engine is in a feedback control region;

comparing a phase of the first feedback correction coefficient with a phase of the detected air/fuel ratio;

discriminate whether the controller has calculated the first feedback correction coefficient in an instable condition based upon a result of the comparison, while causing said adaptation mechanism to estimate said controller parameters such that the controller restores stability when it is discriminated that the controller has calculated the first feedback correction coefficient in an instable condition; and control the fuel injector means to inject fuel into the cylinder based on the determined output quantity of fuel injection.

29. A system according to claim 28, wherein said controller is further configured to:

calculate a second feedback correction coefficient using a second control law whose control response is less than that of the first control law, to correct the basic quantity of the fuel injection such that the controlled variable is brought to the desired value; and correct the basic quantity of fuel injection based upon the second feedback correction coefficient when the controller discriminates that the first feedback correction coefficient was determined in an instable condition.

30. A system according to claim 29, wherein the second control law comprises a PID control law, which includes at least one of a P gain, an I gain, and a D gain.

31. A system according to claim 29, wherein the control law utilized by the controller in a recursion formula comprises an adaptive control law.

32. A system according to claim 28, wherein the first control law utilized by the controller in a recursion formula comprises an adaptive control law.

33. A system according to claim 32, wherein said controller is further configured to:

estimate controller parameters utilizing adaptive control and adaptation, and to calculate the first feedback correction coefficient using internal variables including at least the controller parameters.

34. A system according to claim 33, wherein said controller is further configured to multiply the feedback correction coefficient by the basic quantity of fuel injection.

35. A system for controlling fuel metering for an internal combustion engine having a plurality of cylinders and an exhaust system, said system comprising:

an air/fuel ratio sensor installed in the exhaust system of the engine for detecting an air/fuel ratio of the engine;

engine operating condition detecting means for detecting engine operating conditions including at least engine speed and engine load;

fuel injector means connected to the engine for injecting fuel into a cylinder of the engine; and a controller coupled to said air/fuel ratio sensor, said engine operating condition detecting means, and said fuel injector means, said controller being configured to determine a basic quantity of fuel injection for the cylinder of the engine based on at least the detected engine operating conditions;

calculate a first feedback correction coefficient using an adaptive controller and an adaptation mechanism that estimates controller parameters that are input to the adaptive controller, wherein a first control law is expressed in a recursion formula to correct the quantity of fuel injection, such that a controlled variable obtained based on the detected air/fuel ratio is brought to a desired value;

determine an output quantity of fuel injection, said output quantity of fuel injection being determined by the basic quantity of fuel injection being corrected by the first feedback correction coefficient when the engine is in a feedback control region;

comparing the first feedback correction coefficient with the detected air/fuel ratio;

discriminate whether the controller has calculated the first feedback correction coefficient in an instable condition based upon a result of the comparison, while causing said adaptation mechanism to estimate said controller parameters such that the controller restores stability when it is discriminated that the controller has calculated the first feedback correction coefficient in an instable condition; and control the fuel injector means to inject fuel into the cylinder based on the determined output quantity of fuel injection; wherein said controller is further configured to discriminate whether the first feedback correction coefficient and the detected air/fuel ratio are in phase with each other, and to discriminate that the first feedback correction coefficient was determined in an instable condition when the feedback correction coefficient and the detected air/fuel ratio are determined to be in phase.

36. A system according to claim 35, wherein said controller is further configured to discriminate whether the feedback correction coefficient and the detected air/fuel ratio are in phase for a predetermined number of intervals, and to discriminate that the first feedback correction coefficient was determined in an instable condition when the feedback correction coefficient and the detected air/fuel ratio are discriminated to be in phase for the predetermined number of intervals.

37. A system according to claim 36, wherein said controller is further configured to:

count up the number of times that the first and second differences are determined to be greater than zero when the first difference is found to be greater than the prescribed value to a counted number, and to count down the counted number when the first and second differences are found to be no more than zero or when the first difference is found to be no more than the prescribed value; and discriminate that the first feedback correction coefficient was determined in an instable condition when the counted number reaches the reference value.

38. A system according to claim 35, wherein said controller is further configured to:

calculate a first difference between the desired value and the detected air/fuel ratio to compare the difference with a prescribed value;

calculate a second difference between the first feedback correction coefficient and 1.0;

compare the first and second differences with zero when the first difference is found to be greater than the prescribed value; and discriminate that the first feedback correction coefficient was determined in an instable condition when the first and second differences are found to be greater than zero.

39. A system according to claim 35, wherein said controller is further configured to:

calculate a first difference between the desired value and the detected air/fuel ratio to compare the first difference with a prescribed value for a predetermined number of intervals;

calculate a second difference between the first feedback correction coefficient and 1.0;

compare the first and second differences with zero for the predetermined number of intervals when the first difference is found to be greater than the prescribed value;

count a number of times that the first and second differences are found to be greater than zero when the first difference is found to be greater than the prescribed value; and discriminate that the first feedback correction coefficient was determined in an instable condition when the counted number reaches a predetermined reference value.

40. A system according to claim 35, wherein said controller is further configured to:

calculate a second feedback correction coefficient using a second control law whose control response is less than that of the first control law, to correct the basic quantity of the fuel injection such that the controlled variable is brought to the desired value; and correct the basic quantity of fuel injection based upon the second feedback correction coefficient when the controller discriminates that the first feedback correction coefficient was determined in an instable condition.

41. A system according to claim 40, wherein the second control law comprises a PID control law, which includes at least one of a P gain, an I gain, and a D gain.

42. A system according to claim 35, wherein the first control law utilized by the controller in a recursion formula comprises an adaptive control law.

43. A system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a basic quantity of fuel injection for a cylinder of the engine based on at least the detected engine operating conditions;

a feedback system having a controller means for calculating a feedback correction coefficient, using a control law expressed in a recursion formula, to correct the basic quantity of fuel injection, such that a controlled variable obtained based on at least the detected air/fuel ratio detected by said air/fuel ratio sensor is brought to a desired value;

output fuel injection quantity determining means operatively coupled to said fuel injection quantity determining means and said feedback system, for determining an output quantity of fuel injection, said output fuel injection quantity determining means correcting the basic quantity of fuel injection based on the feedback correction coefficient to determine the output quantity of fuel injection when engine operation is in a feedback control region; and a fuel injector means operatively coupled to said output fuel injection quantity determining means, for injecting fuel in the cylinder of the engine based on the determined output quantity of fuel injection;

wherein:

comparing means are provided for comparing the feedback correction coefficient with the detected air/fuel ratio; and feedback system instability discriminating means are provided and operatively coupled to said feedback system, for discriminating whether said feedback system is instable based on a result of the comparison, wherein said comparing means comprises:

phase discriminating means for discriminating whether the feedback correction coefficient and the detected air/fuel ratio are in phase; and said feedback system instability discriminating means discriminates that said feedback system is instable when the feedback correction coefficient and the detected air/fuel ratio are determined to be in phase.

44. A system according to claim 43, wherein said phase discriminating means discriminates whether the feedback correction coefficient and the detected air/fuel ratio are in phase for a predetermined number of intervals; and said feedback system instability discriminating means discriminates that said feedback system is instable when the feedback correction coefficient and the detected air/fuel ratio are discriminated to be in phase for the predetermined number of intervals.

45. A system according to claim 43, wherein said phase discriminating means comprises:

air/fuel ratio difference calculating means for calculating a first difference between the desired value and the detected air/fuel ratio to compare it with a prescribed value;

coefficient difference calculating means for calculating a second difference between the feedback correction coefficient and 1.0;

difference comparing means for comparing the first and the second differences with zero, when the first difference is found to be greater than the prescribed value; and said feedback system instability discriminating means discriminates that said feedback system is instable when the first and the second differences are found to be greater than zero.

46. A system according to claim 45, wherein said counting means counts up the number of times that the first and the second differences are found to be greater than zero when the first difference is found to be greater than the prescribed value, while it counts down the counted number when the first and the second differences are found to be not greater than zero or when the first difference is found to be not greater than the prescribed value; and wherein said feedback system instability discriminating means discriminates that said feedback system is instable when the counted number reaches the reference value.

47. A system according to claim 43, wherein said phase discriminating means comprises:

air/fuel ratio difference calculating means for calculating a first difference between the desired value and the detected air/fuel ratio to compare it with a prescribed value for a predetermined number of intervals;

coefficient difference calculating means for calculating a second difference between the feedback correction coefficient and 1.0;

difference comparing means for comparing the first and the second differences with zero for the predetermined number of intervals, when the first difference is found to be greater than the prescribed value;

counting means for counting the number of times that the first and the second differences are found to be greater than zero when the first difference is found to be greater than the prescribed value; and wherein said feedback system instability discriminating means discriminates that said feedback system is instable when the counter number reaches a reference value.

48. A system according to claim 43, further including:

a second feedback system having a second controller means for calculating a second feedback correction coefficient, using a second control law whose control response is less than that of the first control law, to correct the basic quantity of fuel injection such that the controlled variable is brought to the desired value; and wherein said output fuel injection quantity determining means corrects the basic quantity of fuel injection based on the second feedback correction coefficient, when said system instability discriminating means discriminates that said first feedback system is instable.

49. A system according to claim 48, wherein the second control law is a PID control law that includes at least one of a P gain, an I gain and a D gain.

50. A system according to claim 43, wherein the control law expressed in a recursion formula is an adaptive control law.

51. A computer program controlled system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a basic quantity of fuel injection for a cylinder of the engine based on at least the detected engine operating conditions;

a feedback system having a controller means for calculating a feedback correction coefficient, using a control law expressed in a recursion formula, to correct the basic quantity of fuel injection, such that a controlled variable obtained based on at least the detected air/fuel ratio detected by said air/fuel ratio sensor is brought to a desired value;

output fuel injection quantity determining means operatively coupled to said fuel injection quantity determining means and said feedback system, for determining an output quantity of fuel injection, said output fuel injection quantity determining means correcting the basic quantity of fuel injection based on the feedback correction coefficient to determine the output quantity of fuel injection when engine operation is in a feedback control region; and a fuel injector means operatively coupled to said output fuel injection quantity determining means, for injecting fuel in the cylinder of the engine based on the determined output quantity of fuel injection;

wherein:

comparing means are provided for comparing the feedback correction coefficient with the detected air/fuel ratio; and feedback system instability discriminating means are provided and operatively coupled to said feedback system, for discriminating whether said feedback system is instable based on a result of the comparison, wherein said comparing means comprises:

phase discriminating means for discriminating whether the feedback correction coefficient and the detected air/fuel ratio are in phase; and said feedback system instability discriminating means discriminates that said feedback system is instable when the feedback correction coefficient and the detected air/fuel ratio are discriminated to be in phase.

52. A method for controlling fuel metering for an internal combustion engine having a plurality of cylinders and an exhaust system, said method comprising the steps of:

detecting an air/fuel ratio of the engine;

detecting engine operating conditions including at least engine speed and engine load;

determining a basic quantity of fuel injection for a cylinder of the engine based on at least the detected engine operating conditions;

controlling with a feedback system having controller means for calculating a feedback correction coefficient, using a control law expressed in a recursion formula, to correct the basic quantity of fuel injection, such that a controlled variable obtained based on at least the detected air/fuel ratio is brought to a desired value;

determining an output quantity of fuel injection, while correcting the basic quantity of fuel injection based on the feedback correction coefficient to determine the output quantity of fuel injection when engine operation is in a feedback control region; and injecting fuel in the cylinder of the engine based on the determined output quantity of fuel injection;

wherein:

comparing the feedback correction coefficient with the detected air/fuel ratio; and discriminating whether said feedback system is instable based on a result of the comparison, wherein said step of comparing comprises the steps of:

discriminating whether the feedback correction coefficient and the detected air/fuel ratio are in phase; and discriminating that said feedback system is instable when the feedback correction coefficient and the detected air/fuel ratio are discriminated to be in phase.

53. A system for controlling fuel metering for an internal combustion engine having a plurality of cylinders and an exhaust system, said system comprising:

an air/fuel ratio sensor installed in the exhaust system of the engine for detecting an air/fuel ratio of the engine;

engine operating condition detecting means for detecting engine operating conditions including at least engine speed and engine load;

fuel injector means connected to the engine for injecting fuel into a cylinder of the engine; and a controller coupled to said air/fuel ratio sensor, said engine operating condition detecting means, and said fuel injector means, said controller being configured to determine a basic quantity of fuel injection for the cylinder of the engine based on at least the detected engine operating conditions;

calculate a first feedback correction coefficient using a first control law expressed in a recursion formula to correct the basic quantity of fuel injection, such that a controlled variable obtained based on the detected air/fuel ratio is brought to a desired value;

determine an output quantity of fuel injection, said output quantity of fuel injection being determined by the basic quantity of fuel injection being corrected by the first feedback correction coefficient when the engine is in a feedback control region;

comparing the first feedback correction coefficient with the detected air/fuel ratio;

discriminate whether the controller has calculated the first feedback correction coefficient in an instable condition based upon a result of the comparison; and control the fuel injector means to inject fuel into the cylinder based on the determined output quantity of fuel injection, wherein said controller is further configured to discriminate whether the first feedback correction coefficient and the detected air/fuel ratio are in phase with each other, and to discriminate that the first feedback correction coefficient was determined in an instable condition when the feedback correction coefficient and the detected air/fuel ratio are discriminated to be in phase.

54. A system according to claim 53, wherein said controller is further configured to discriminate whether the feedback correction coefficient and the detected air/fuel ratio are in phase for a predetermined number of intervals, and to discriminate that the first feedback correction coefficient was determined in an instable condition when the feedback correction coefficient and the detected air/fuel ratio are discriminated to be in phase for the predetermined number of intervals.

55. A system according to claim 53, wherein said controller is further configured to:

calculate a first difference between the desired value and the detected air/fuel ratio to compare the difference with a prescribed value;

calculate a second difference between the first feedback correction coefficient and 1.0;

compare the first and second differences with zero when the first difference is found to be greater than the prescribed value; and discriminate that the first feedback correction coefficient was determined in an instable condition when the first and second differences are found to be greater than zero.

56. A system according to claim 55, wherein said controller is further configured to:

count up the number of times that the first and second differences are determined to be greater than zero when the first difference is found to be greater than the prescribed value to a counted number, and to count down the counted number when the first and second differences are found to be no more than zero or when the first difference is found to be no more than the prescribed value; and discriminate that the first feedback correction coefficient was determined in an instable condition when the counted number reaches the reference value.

57. A system according to claim 53, wherein said controller is further configured to:

calculate a first difference between the desired value and the detected air/fuel ratio to compare the first difference with a prescribed value for a predetermined number of intervals;

calculate a second difference between the first feedback correction coefficient and 1.0;

compare the first and second differences with zero for the predetermined number of intervals when the first difference is found to be greater than the prescribed value;

count a number of times that the first and second differences are found to be greater than zero when the first difference is found to be greater than the prescribed value; and discriminate that the first feedback correction coefficient was determined in an instable condition when the counted number reaches a predetermined reference value.

58. A system according to claim 53, wherein said controller is further configured to:

calculate a second feedback correction coefficient using a second control law whose control response is less than that of the first control law, to correct the quantity of the fuel injection such that the controlled variable is brought to the desired value; and correct the basic quantity of fuel injection based upon the second feedback correction coefficient when the controller discriminates that the first feedback correction coefficient was determined to be instable.

59. A system according to claim 58, wherein the second control law comprises a PID control law, which includes at least one of a P gain, an I gain, and a D gain.

60. A system according to claim 53, wherein the first control law utilized by the controller in a recursion formula comprises an adaptive control law.

* * * * *